US005337944A

United States Patent [19]

Shiba

[11] Patent Number: 5,337,944

[45] Date of Patent: Aug. 16, 1994

[54] PAPER WEB GUIDE DEVICE HAVING ALTERNATING DRIVING AND BRAKING GUIDE ROLLERS

[75] Inventor: Noriyuki Shiba, Tokyo, Japan

[73] Assignee: Kabushikigaisha Tokyo Kikai Seisakusho, Tokyo, Japan

[21] Appl. No.: 38,030

[22] Filed: Feb. 19, 1993

Related U.S. Application Data

[63] Continuation of Ser. No. 619,955, Nov. 30, 1990, abandoned.

[30] Foreign Application Priority Data

Dec. 4, 1989 [JP] Japan ..... 1-314576

[51] Int. Cl.[5] ..... B41F 13/02

[52] U.S. Cl. ..... 226/108; 101/417

[58] Field of Search ..... 226/108, 24, 38, 39, 226/188, 189, 195; 101/417, 228, DIG. 41

[56] References Cited

U.S. PATENT DOCUMENTS

| | | | |
|---|---|---|---|
| 1,994,404 | 3/1935 | Reiners et al. | 242/18 |
| 3,469,751 | 9/1969 | Tyrner et al. | 226/25 |
| 3,837,550 | 9/1974 | Levy | 226/189 X |
| 3,858,870 | 1/1975 | Yabe et al. | 226/189 X |
| 4,563,950 | 1/1986 | Fisher | 101/417 X |
| 4,930,415 | 6/1990 | Hara et al. | 101/228 |
| 4,951,567 | 8/1990 | Rodi et al. | 101/DIG. 41 X |

FOREIGN PATENT DOCUMENTS

| | | | |
|---|---|---|---|
| 2802153 | 7/1979 | Fed. Rep. of Germany | 101/DIG. 41 |
| 62-132644 | 6/1987 | Japan . | |
| 62-149449 | 7/1987 | Japan . | |
| 62-255150 | 11/1987 | Japan . | |
| 62-256657 | 11/1987 | Japan . | |
| 63-33941 | 3/1988 | Japan . | |
| 63-268648 | 11/1988 | Japan . | |
| 63-268649 | 11/1988 | Japan . | |
| 64-31641 | 2/1989 | Japan . | |
| 1-204740 | 8/1989 | Japan . | |
| 1-209139 | 8/1989 | Japan . | |

*Primary Examiner*—Daniel P. Stodola
*Attorney, Agent, or Firm*—Foley & Lardner

[57] ABSTRACT

A paper web guide device for guiding and conveying a paper web comprises a plurality of guide rollers arranged in a parallel configuration in a printing system. The guide rollers comprise a mix of driving guide rollers equipped with a driving mechanism and braking guide rollers equipped with a braking mechanism. The driving guide rollers are controlled so as to make the revolving speed of the guide rollers faster than the travelling speed of the paper web. The braking guide rollers are controlled so as to make the revolving speed of the guide rollers slower than the travelling speed of the paper web. This guide device can exactly perform a cleaning operation on the guide rollers within a short period and without accumulating the tension applied to the travelling paper web.

9 Claims, 5 Drawing Sheets

PAPER WEB GUIDE DEVICE HAVING ALTERNATING DRIVING AND BRAKING GUIDE ROLLERS

This application is a continuation of application Ser. No. 07/619,955, filed Nov. 30, 1990, now abandoned.

BACKGROUND OF THE INVENTION

1. Field of the Invention

The present invention generally relates to a paper web guide device equipped with a plurality of guide rollers for guiding a paper web which is conveyed through a processing machine such as a rotary press. More particularly, the present invention relates to a paper web guide device with an automatically controlled self-cleaning mechanism for cleaning the circumferential surface of the guide roller.

2. Prior Art

Various paper web guide device with such type of self-cleaning mechanism have been conventionally shown in Japanese Patent Application Laid-Open Publications No. 62-132644 entitled "Cleaning Method in Rotary Press and Device of the Same"; No. 62-149449 entitled "Cleaning Method for Guide Roller in Rotary Press and Device of the Same"; No. 62-255150 entitled "Cleaning Device for Guide Roller in Rotary Press"; No. 62-256657 entitled "Cleaning Method for Guide Roller in Rotary Press"; Japanese Patent Under Utility Model Application Laid-Open Publications No. 63-33941 entitled "Stain Preventing Device for Guide Roller in Rotary Press"; Japanese Patent Application Laid-Open Publications No. 63-268648 entitled "Cleaning Method for Guide Roller in Rotary Press"; No. 63-268649 entitled "Cleaning Method for Guide Roller in Rotary Press"; No. 64-31641 entitled "Cleaning Method for Rotary Press"; No. 1-204740 entitled "Automatic Cleaning Device for Web Guide Roller" and No. 1-209139 entitled "Guide Roller Device in Rotary Press".

The above described publications wholly relate to the methods and devices to clean the circumferential surface of the guide roller by rubbing the guide surface with the paper web. In these methods and devices, the rubbing motion is generated by controlling the circumferential speed of the guide rollers to be different from that of the travelling speed of the paper web.

For example, the device shown in Japanese Patent Application Laid-Open Publication No. 1-209139 teaches a linkage mechanism which controls the revolving speed of at least one of a plurality of guide rollers to be different from the other guide rollers for driving the guide rollers by the contact-friction force between travelling paper web and the guide rollers. The contact-friction force of the guide roller depends on the wind angle of the travelling web, and therefore the driving force for the guide roller is transmitted to the other guide roller through the linkage mechanism. Thus, the guide rollers are respectively driven at various circumferential speeds which are different from the travelling speed of the paper web.

In the other conventional devices and methods the respective guide rollers are positively controlled by driving means or braking means to forcibly control the circumferential speed of the guide rollers to be different from the travelling speed of the paper web. The conventional devices and methods use either driving means or braking means for positively controlling plural guide rollers.

The above described conventional devices and methods exhibit some problems requiring resolution.

For example, the device shown in Japanese Patent Application Laid-Open Publication No. 1-209139 entitled "Guide Roller Device in Rotary Press" uses the contact-friction force between the paper web and the circumferential surface of the guide roller as the driving force for the guide rollers. According to this device the difference between the travelling speed of the paper web and the revolving speed of the guide roller is autonomously generated within the allowable range of the tension applied to the paper web so as to prevent the paper web from excessive tension. The revolving forces for the respective guide rollers connected through the linkage depend on the wind angle of the travelling web around the respective guide rollers. However, when the difference between the minimum value and the maximum value of the wind angles is excessive, the revolving force depending on the maximum angle is almost not affected by that of the minimum angle. Thus, the revolving speed of the maximum wind angle roller is almost the same as the travelling speed of the paper web. The circumferential surface of this maximum wind angle roller is not effectively cleaned. Consequently, this device will cause a further problem in the design stage in that the selection of the kind, combination, and configuration of the plural guide rollers to be connected with the linkage means are very difficult to determine.

The above described conventional devices and methods, except for Japanese Patent Application Laid-Open Publications No. 1-209139, employ forcible control systems for making the revolving speed of the guide roller to be different from the travelling speed of the paper web by either driving or braking all of the plural guide rollers at the same time. Although this system can effectively clean the respective circumferential surfaces of the guide rollers, the paper web will sometimes be subjected to great tension at the beginning of the driving and braking operations. Particularly, when the travelling length of the paper web is relatively long and many guide rollers are arranged along the travelling path, the tension will be continuously and accumulatively applied to the paper web in its longitudinal direction. As a result, the tension will exceed the allowable value when all of the guide rollers are simultaneously driven or stopped.

In order to resolve this problem, for example Japanese Patent Under Utility Model Application Laid-Open Publications No. 63-33941 entitled "Stain Preventing Device for Guide Roller in Rotary Press" shows a gradual control system for gradually braking or driving the guide rollers in a predetermined order. Alternatively, Japanese Patent Application Laid-Open Publications No. 63-268649 entitled "Cleaning Method for Guide Roller in Rotary Press" shows a method that all of the guide rollers should be driven or braked at the same occasion with decreasing or cancelling the back-tension applied to the paper web as requirement and confirming the travelling condition of the paper web at a slow speed. Accordingly, these conventional devices and methods require an extremely long time for cleaning the circumferential surface of the guide rollers by the travelling paper web.

SUMMARY OF THE INVENTION

It is an object of the present invention to provide a paper web guide device which can surely perform an effective cleaning operation on the circumferential surface of the guide rollers.

Another object of the present invention is to provide a paper web guide device which can perform a cleaning operation on the circumferential surface of the guide rollers within a short time.

A still further object of the present invention is to provide a paper web guide device which is easily designed.

These and other objects of the present invention are attained by providing a paper web guide device wherein one type of guide rollers with driving means and the other type of guide rollers with braking means are mixedly configured.

Other features and advantages of the invention will be apparent from the following description taken in connection with the accompanying drawings.

DETAILED DESCRIPTION OF THE PREFERRED EMBODIMENT

One preferred embodiment of the present invention will be described in conjunction with the accompanying drawings.

Figure 6:
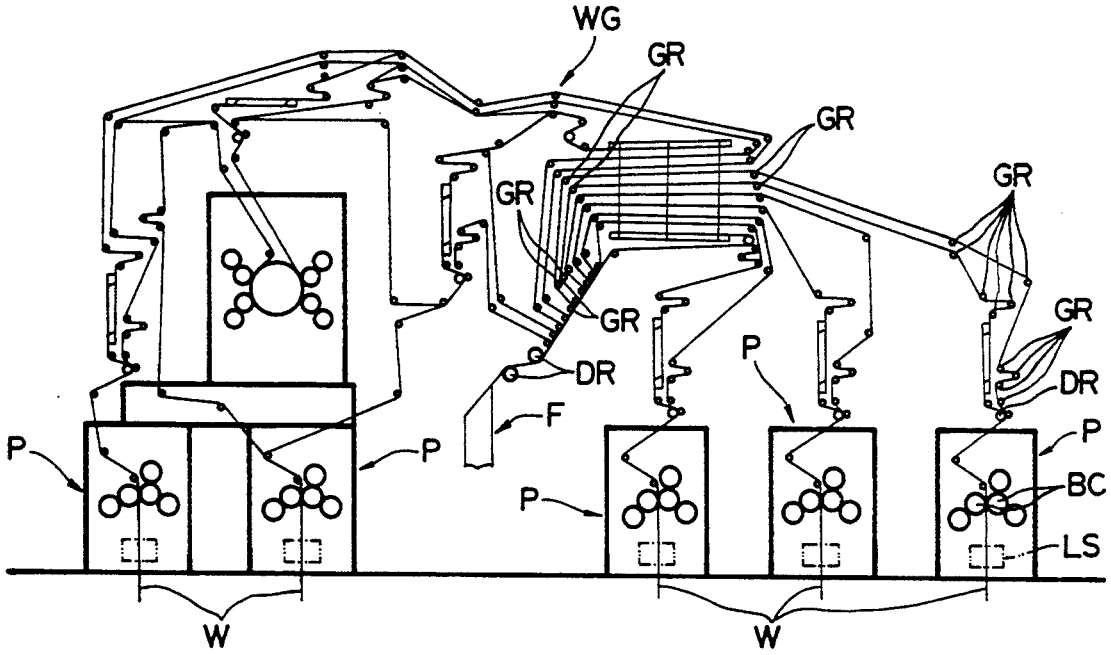
FIG. 6 is a schematic illustration showing an overall view of an example of an offset printing apparatus in which a plurality of paper web guide devices according to the present invention are systematically arranged.

To print a newspaper by a rotary press, for example an offset rotary press as shown in FIG. 6, a plurality of paper webs W, W, . . . are fed from paper feeding units, not shown, to respective printing units P, P, . . . . In each printing unit P, the paper web W is printed between a pair of blanket cylinders BC and BC and moved forwardly by the revolving force between the blanket cylinders BC and BC. Then the paper webs W are guided and conveyed by a web guide system WG including a plurality of guide rollers GR, turning bars TB, and drag rollers DR, and finally fed into a folding unit F.

Figure 1:
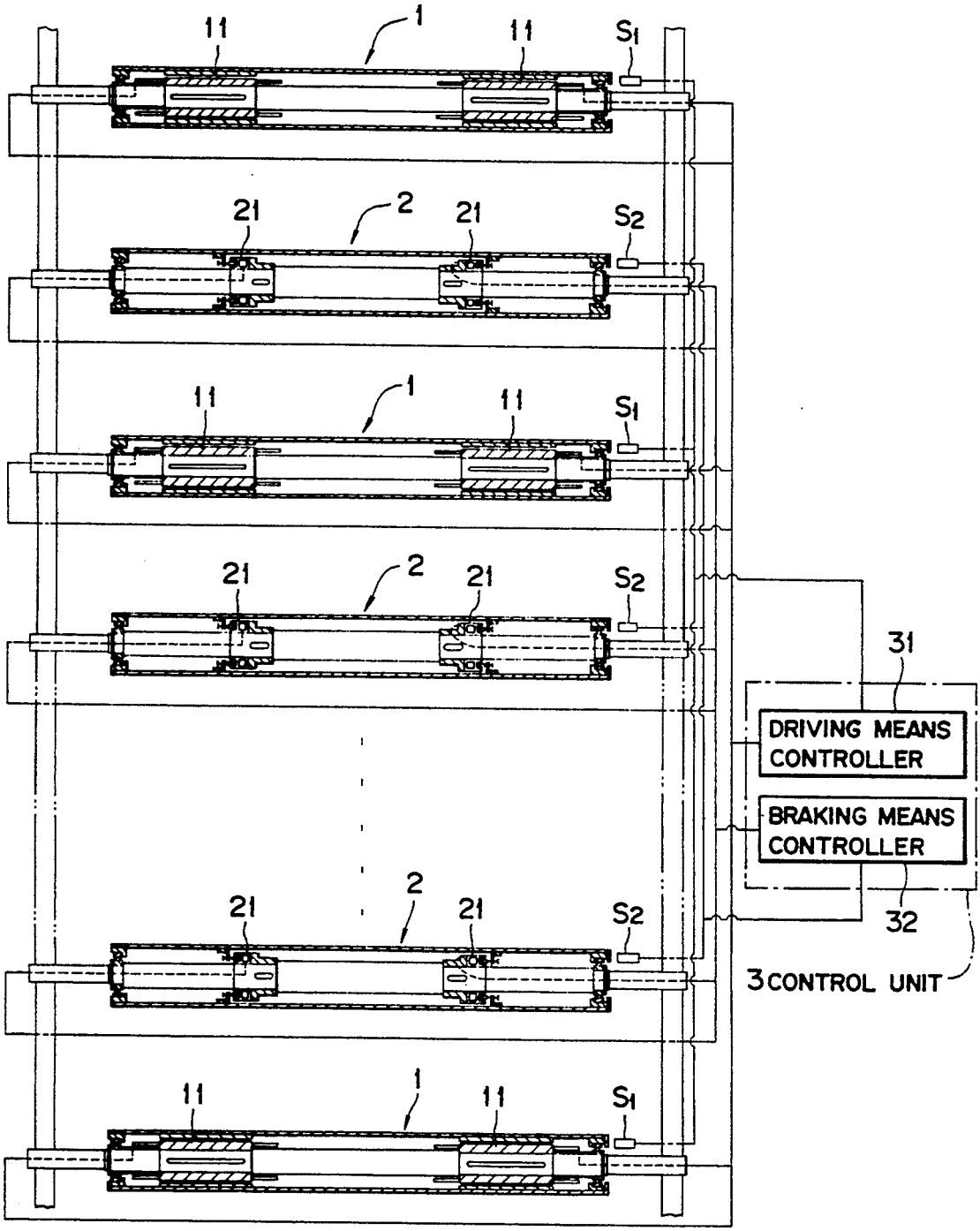
FIG. 1 is a partial sectional view showing an overall configuration of a paper web guide device according to one embodiment of the present invention.

This web guide system WG includes a paper web guide device according to one preferred embodiment of the present invention shown in FIG. 1. The paper web guide device comprises a plurality of driving guide rollers 1 equipped with driving means 11 and a plurality of braking guide rollers 2 equipped with braking means 21. The driving guide rollers 1 and the braking guide rollers 2 are alternately arranged. The device WG further includes a control unit 3 for controlling the driving means 11 and the braking means 21.

The control unit 3 is composed of a driving means controller 31 which outputs a drive-signal to the driving means 11 to make the driving guide roller 1 revolve faster than the travelling speed of the web W, and a braking means controller 32 which outputs a brake-signal to the braking means 21 to make the braking guide roller 2 revolve slower than the travelling web W. The control unit 3 is electrically connected to a main control panel, not shown, for this printing system. While the printing system is operating, an information signal representing the travelling speed of the paper web W is always input into the control unit 3. On the other way, the driving means controller 31 and the braking means controller 32 are electrically connected to a plurality of speed sensors S1 for the driving guide rollers 1 and a plurality of speed sensors S1 for the driving guide rollers 1 and a plurality of speed sensors S2 for the braking guide rollers 2, respectively. Each of the speed sensors S1 detects the revolving speed of the driving guide roller 1 and outputs a signal to the driving means controller 31 according to the detection. Also each speed sensor S2 detects the revolving speed of the braking guide rollers 2 and outputs a signal to the braking means controller 32.

An operation of this control system will be described in detail. In order to clean the circumferential surface of the guide rollers 1, . . . , 2, . . . , a cleaning operation start signal is input to the control unit 3 from the main control panel by manually switching on a start switch or by automatically switching in accordance with an automatic operation control signal from the rotary press. The driving means controller 31 compares the revolving speed of the driving guide roller 1 with the travelling speed of the paper web W, and outputs the drive-signal to the driving means 11. The driving means 11 is actuated to drive the driving guide roller 1 so as to make the circumferential revolving speed of the driving guide roller 1 be scarcely faster than the travelling speed of the paper web W. At the same time, the braking means controller 32 compares the revolving speed of the braking guide roller 2 with the travelling speed of the paper web W, and outputs the brake-signal to the braking means 21. The braking means 21 is actuated to brake the braking guide roller 2 so as to make the circumferential revolving speed of the braking guide roller 2 be somewhat slower than the travelling speed of the paper web W. According to this control, the circumferential surfaces of the driving guide rollers 1, . . . and the braking guide rollers 2, . . . are forcibly rubbed by the paper web W.

Under this cleaning operation, the paper web W travelling from the driving guide roller 1 to the braking guide roller 2 is slightly loosened to decrease its tension, and on the other hand the paper web W travelling from the braking guide roller 2 to the driving guide roller 1 is somewhat stretched to increase its tension. Thus, the paper web W is subjected to such alternation of stretched and loosened states along this guide device.

This guide device does not apply continuous tension onto the paper web, therefore the tension is not accumulated. The paper web W can be conveyed at a constant speed. Further this guide device can remove a complicated operation which is required in a conventional device to release or decrease the backtension applied to the paper web W at the paper feeding unit.

The cleaning operation is stopped as a stop signal is input into the control unit 3 in the same manner as the start operation.

Figure 2:
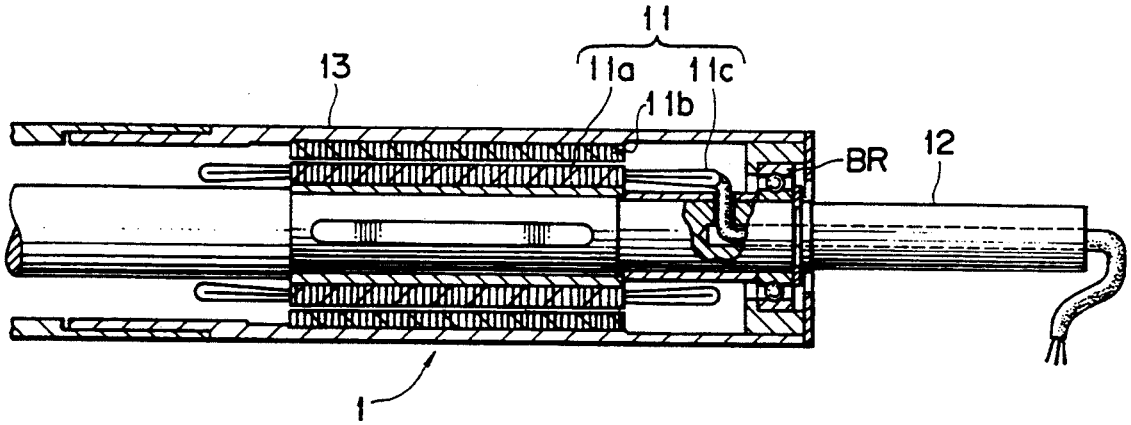
FIG. 2 is a longitudinal cross-sectional view showing a guide roller driving means installed in the guide roller to be driven.
Figure 3:
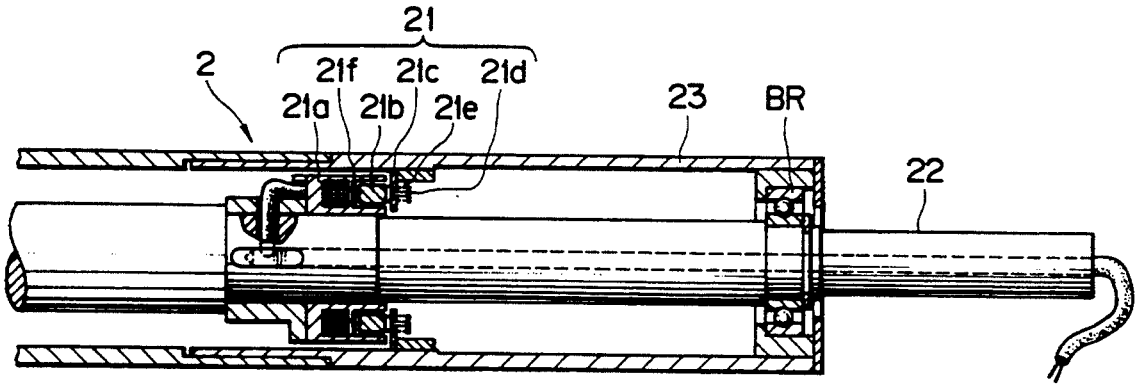
FIG. 3 is a longitudinal cross-sectional view showing a guide roller braking means installed in the guide roller to be braked.

FIG. 2 and FIG. 3 show the driving means 11 for the driving guide roller 1 and the braking means 21 for the braking guide roller 2, respectively. The driving means 11 is installed in the driving guide roller 1.

In detail, the driving means 11 comprises a stationary member 11*a* fixed on a stationary shaft 12 of the guide roller 1, a movable member 11*b* fixed on a cylinder 13 of the guide roller 1, and a coil 11*c* electrically connected to the stationary member 11*a*. When the coil 11*c* is energized, the movable member 11*b* revolves about the stationary member 11*a*. According to this revolving motion, the cylinder 13 revolves about the stationary shaft 12. The revolving speed of the movable member 11*b* is controlled by a frequency control of an inverter.

On the other hand, as illustrated in FIG. 3, the braking means 21 is also installed in the braking guide roller 2. A coil 21*a* is fixed on a stationary shaft 22 of the braking guide roller 2. A cylinder 23 is provided with a flange 21*c* on the inside wall of the cylinder 23. An armature 21*b* is secured to the flange 21 through a pin 21*d* and a spring 21*e*. When the coil 21*a* is energized, the armature 21*b* is attracted to a steel plate 21*f* fixed to the coil 21*a*. According to this attracting movement, the revolving motion of the cylinder 23 is braked. The braking force is controlled by changing the voltage applied to the coil 21*b*.

Since the driving means 11 and the braking means 21 can be respectively installed in the interior of the driving guide roller 1 and the braking guide roller 2, these means will be easily applied to a closed configuration that many guide rollers are arranged in a narrow space. The driving means 11 and the braking means 21 are not actuated while the electric voltage is not applied to the coils 11*c* and 21*a*. Under this off-condition, the guide rollers 1 and 2 can be freely revolved about the stationary shafts 12 and 22 through bearings BR.

Figure 4:
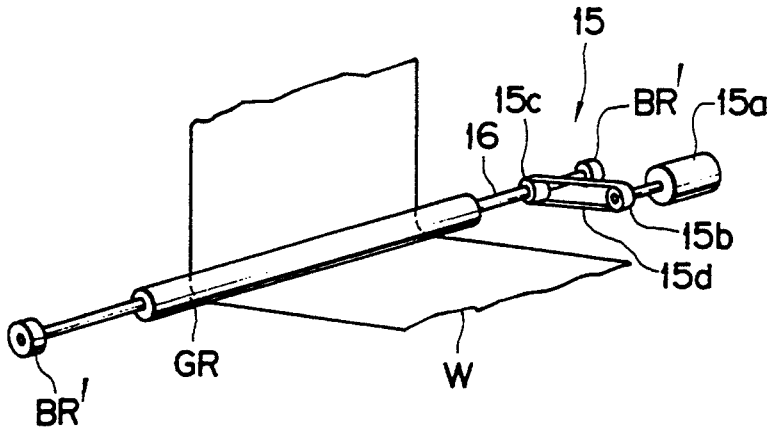
FIG. 4 is a schematic illustration showing another driving system for driving the guide roller.
Figure 5:
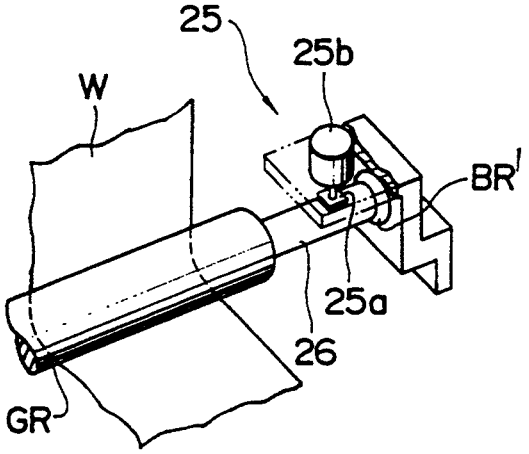
FIG. 5 is a schematic illustration showing another braking system for braking the guide roller.

FIG. 4 and FIG. 5 show other configurated driving and braking means 15 and 25 which are different from the configurations shown in FIG. 2 and FIG. 3.

As shown in FIG. 4, the driving means 15 is assembled on one end of a shaft 16 of a driving guide roller GR1'. The driving means 15 comprises a drive unit 15*a*, a pair of pulleys 15*b* and 15*c*, and a drive belt 15*d*. Both the ends of the shaft 16 are supported by bearings BR', BR'. In general usage, the pulley 15*b* or 15*c* is further provided with a clutch, not shown, to engage or disengage between the drive unit 15*a* and the shaft 16. As the clutch mechanically connects between the drive unit 15*a* and the shaft 16 in response to a drive operation start signal, the driving force from the drive unit 15*a* makes the driving guide roller 1' revolve.

As shown in FIG. 5, the braking means 25 is also assembled on one end of a shaft 26 of a braking guide roller GR2'. The braking means 25 comprises a braking unit 25*a* and a hydraulic cylinder 25*b*. The braking unit 25*a* is always isolated from the shaft 26. As the hydraulic cylinder 25*b* extends its rod in response to a brake operation start signal, the braking unit 25*a* is forcibly brought into contact with the shaft 26 to brake the revolving motion of the shaft 26. The braking section is not only limited to FIG. 5, but the braking unit 25*a* may be also arranged to be in contact with the circumferential surface of the guide roller GR2'.

The paper web guide device according to the present invention can be further provided with a cleaning liquid supplying means in order to increase the cleaning effect of the device. FIG. 7 to FIG. 10 show various examples of such cleaning liquid supplying means LS.

Figure 7:
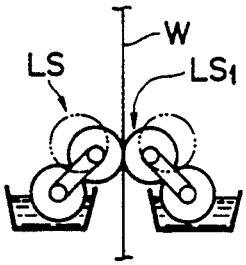
FIG. 7, FIG. 8 and FIG. 9 are schematic illustrations showing various types of cleaning liquid supplying means which are combined with the paper web guide device to improve a cleaning effect.
Figure 8:
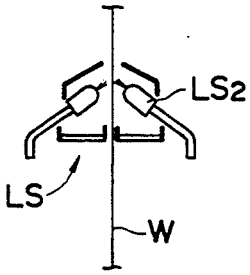
Figure 9:
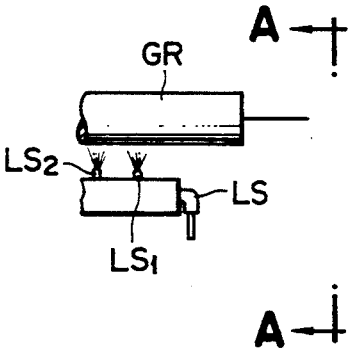
Figure 10:
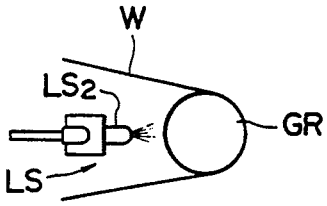
FIG. 10 is a schematically side view of the cleaning liquid supplying means shown in FIG. 9, taken in the direction of the arrows along the line A—A.

FIG. 7 and FIG. 8 show one type which is arranged prior to the blanket cylinders BC as shown in FIG. 6 to supply the cleaning liquid onto the paper web W. Therefore the cleaning liquid is conveyed in the paper web W and transferred onto the guide rollers GR. FIG. 9 and FIG. 10 show the other type which directly supplies the cleaning liquid onto the guide roller GR. In FIG. 9, ther paper web W is not shown. FIG. 10 shows the same means of FIG. 9, taken in the direction of the arrows along the line A—A in FIG. 9.

The means shown in FIG. 7 can intermittently supply the cleaning liquid by reciprocally moving a cleaning liquid supplying roller LS1 between a contact state represented by a solid line and an isolate state represented by a phantom line. Also the means shown in FIG. 8, FIG. 9, and FIG. 10 can intermittently supply the cleaning liquid by intermitting the injection from one or two nozzles LS2.

After a cleaning operation, the cleaning liquid supplying operation is stopped and the paper web is somewhat travelled on the guide rollers in order to remove the cleaning liquid. Thus the cleaning operation with the cleaning liquid is preferably performed before or after printing opration.

Figure 11:
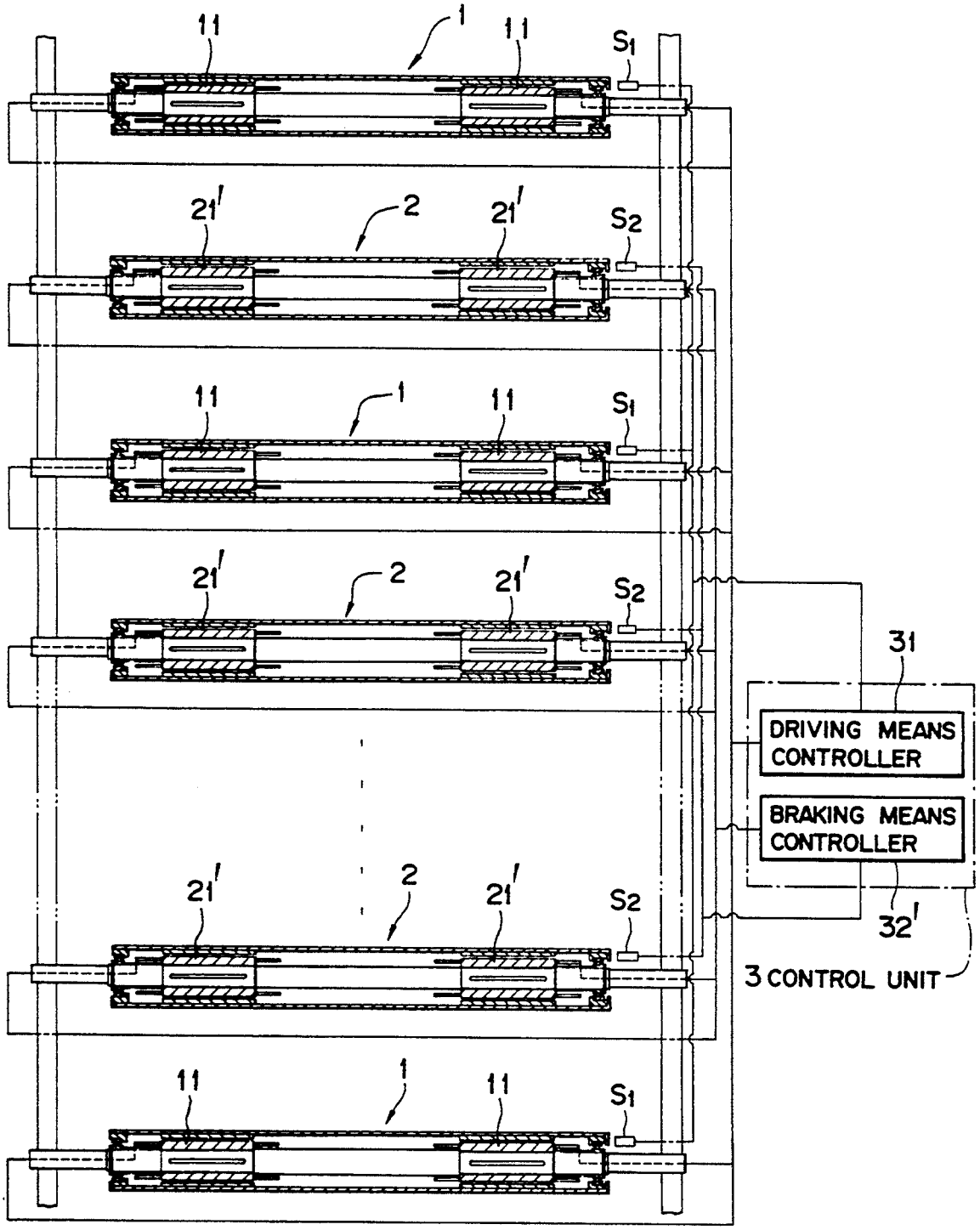
FIG. 11 is a partial sectional view showing an overall configuration of the paper web guide device according to one modification of the device shown in FIG. 1.

The present invention is not only limited to the above described embodiment and can be modified in may variations without departing from the spirit and the scope of the invention as hereinafter claimed. For example, the driving mechanism shown in FIG. 2 or FIG. 4 is used as the braking means. FIG. 11 shows this variation in which the driving means, shown in FIG. 2, are used as the braking means 21' and are connected to a braking means controller 32' which decreases the revolving speed of the guide rollers 2' than the travelling speed of the paper web W.

The paper web guide device according to the present invention does not accumulate the tension onto the paper web even if the travelling speed of the paper web and the revolving speed of the guide roller are different from each other. Therefore, the revolving speed of each guide roller can be forcibly varied with respect to the travelling speed of the paper web without decreasing the travelling speed of the paper web. This ensures that the cleaning operation will be performed on the circumferential surface of the guide roller within a short period.

In this invention, the driving guide rollers and the braking guide rollers are arranged in any configuration which does not apply continuous tension onto the paper web travelling among the guide rollers and does not accumulate the tension.

Further, the driving and braking means can be easily installed in the interior of conventional guide rollers so that the paper web guide device according to the present invention will not increase the space to arrange this device. This will be applied to a complicated or narrow spaces without difficulties in planning.

What is claimed is:

1. A paper web guide device comprising:

(A) a plurality of driving guide rollers arranged in series;

(B) a plurality of driving devices, each of which is connected to one of said driving guide rollers;

(C) a plurality of braking guide rollers, each of which is disposed between successive ones of said driving guide rollers; and (D) a plurality of braking devices, each of which is connected to one of said braking guide rollers;

wherein said driving devices drive said driving guide rollers and said braking devices apply a braking force to said braking guide rollers such that during a cleaning mode, when a paper web is travelling over the driving guide rollers and the braking drive rollers, the driving guide rollers are driven at a different speed from a speed of the braking guide rollers which prevents a continuous tension from being applied along the paper web;

wherein during a normal mode printing operation, said braking guide rollers and said driving guide rollers are only driven by the paper web.

2. The paper web guide device according to claim 1, wherein each of said driving devices is provided inside a corresponding one of the driving guide rollers.

3. The paper web guide device according to claim 1, wherein each of said braking devices is provided inside a corresponding one of the braking guide rollers.

4. The paper web guide device according to claim 1, further comprising a control unit which generates output signals controlling each of said driving devices and said braking devices.

5. The paper web guide device according to claim 4, further comprising sensors which monitor the rotational speeds of said driving guide rollers and said braking guide rollers and which are connected to said control unit.

6. The paper web guide device according to claim 4, wherein said control unit controls said driving devices to cause said driving guide rollers to rotate at a speed which is greater than a speed at which a paper web is being conveyed over said driving guide rollers and said braking guide rollers, and wherein said control unit controls said braking devices to cause said braking guide rollers to rotate at a speed which is less than the speed at which said paper web is being conveyed over said driving guide rollers and said braking guide rollers.

7. A paper web guide device comprising:

(A) a plurality of driving guide rollers arranged in series;

(B) a plurality of driving devices, each of which is connected to one of said driving guide rollers;

(C) a plurality of braking guide rollers, each of which is disposed between successive ones of said driving guide rollers; and (D) a plurality of braking devices, each of which is connected to one of said braking guide rollers;

wherein said driving devices drive said driving guide rollers and said braking devices apply a braking force to said braking guide rollers such that during a cleaning mode, when a paper web is travelling over the driving guide rollers and the braking drive rollers, the driving guide rollers are driven at a different speed from a speed of the braking guide rollers which prevents a continuous tension from being applied along the paper web;

wherein each of said plurality of driving guide rollers is disposed between successive ones of said braking guide rollers.

8. A paper web guide device according to claim 7, wherein the arrangement of the braking guide rollers and driving guide rollers relative to each other creates an alternating plurality of first and second zones, said first zone defined as corresponding to an area traversed by the paper web as it passes from the driving guide rollers to the braking guide rollers and the second zone corresponding to an area traversed by the paper web as it passes from the braking guide rollers to the driving guide rollers;

wherein, during said cleaning mode, the paper web is subjected to loosening in said first zones and stretching in said second zones.

9. A paper web guide device comprising:

(A) a plurality of driving guide rollers arranged in series;

(B) a plurality of driving devices, each of which is connected to one of said driving guide rollers;

(C) a plurality of braking guide rollers, each of which is disposed between successive ones of said driving guide rollers; and (D) a plurality of braking devices, each of which is connected to one of said braking guide rollers;

wherein said driving devices drive said driving guide rollers and said braking devices apply a braking force to said braking guide rollers such that during a cleaning mode, when a paper web is travelling over the driving guide rollers and the braking drive rollers, the driving guide rollers are driven at a different speed from a speed of the braking guide rollers which prevents a continuous tension from being applied along the paper web;

wherein said driving guide rollers and said braking guide rollers are driven in a same direction.

* * * * *